United States Patent [19]

Doleshal

[11] Patent Number: 4,992,000

[45] Date of Patent: Feb. 12, 1991

[54] UNDERWATER TRENCHING SYSTEM

[75] Inventor: Donald L. Doleshal, Overland Park, Kans.

[73] Assignee: Central States Underwater Contracting, Inc., Kansas City, Kans.

[21] Appl. No.: 369,042

[22] Filed: Jun. 19, 1989

[51] Int. Cl.[5] ..... F16L 1/12

[52] U.S. Cl. ..... 405/163; 405/164; 405/158

[58] Field of Search ..... 405/164, 158, 159, 163; 37/59, 61, 62, 63, 75, 76, 78

[56] References Cited

U.S. PATENT DOCUMENTS

| | | | |
|---|---|---|---|
| 2,659,211 | 11/1953 | Notarbartolo et al. . | |
| 3,347,054 | 10/1967 | Sherrod | 405/164 |
| 3,722,224 | 3/1973 | Roy . | |
| 4,041,717 | 8/1977 | Dressel et al. | 37/63 X |
| 4,295,757 | 10/1981 | Gaspar . | |
| 4,342,526 | 8/1982 | Mousselli | 405/159 |
| 4,410,297 | 10/1983 | Lynch | 405/164 |
| 4,479,741 | 10/1984 | Berti et al. . | |
| 4,538,937 | 9/1985 | Lynch | 405/164 X |
| 4,643,613 | 2/1987 | Durner | 405/164 X |
| 4,714,378 | 12/1987 | Lincoln | 405/163 |
| 4,812,079 | 3/1989 | Johnson et al. | 405/164 |

*Primary Examiner*—Dennis L. Taylor
*Assistant Examiner*—J. Russell McBee
*Attorney, Agent, or Firm*—D. A. N. Chase

[57] ABSTRACT

An underwater trenching system comprises a closed trenching system that vacuums up sediment removed during the trenching operation and deposits that same sediment into the trench, thereby burying a pipeline that has settled into the trench. The invention provides a trenching sled having high pressure water jets for digging and a vacuum head and lines for sucking the resulting sediment into a surge tank on a barge, from which it is re-deposited by a bury sled.

16 Claims, 4 Drawing Sheets

UNDERWATER TRENCHING SYSTEM

BACKGROUND OF THE INVENTION

I. Field of the Invention.

The present invention is directed toward an underwater trenching system. More particularly, the present invention digs an underwater trench for burying a cable or pipeline and backfills the trench using the same material that was removed to create the trench.

II. Description of Related Art.

It is frequently necessary or desirable to bury a pipe or cable at the bottom of a waterway, such as a river, lake or sea. Buried lines often include, for example, natural gas lines, petroleum products lines, fiber optic cables, telephone cables, and so forth.

Many such cables or pipelines are simply laid along the bottom of a waterway and left exposed, to be buried by the action of the currents. In other uses, a trenching tool, such as a water jet, a cutter head, or a scoop, or clam shell digger digs a trench around the pipe, which settles into the trench. The bottom matter, sediment, or spoils, blasted away by the cutting head, regardless of the type, is dispersed in the surrounding water where it remains in suspension for a considerable time before eventually settling to the bottom. The sediment may form a large cloud within the body of water, or be carried downstream many miles before eventually settling out of suspension. It has become known that the debris from such trenching operations can cause serious environmental damage to plants, animals, fishes, the water, microorganisms and so forth, particularly in fragile ecosystems.

Typically, no effort is made to cover the pipe or to fill the trench. Only the action of underwater currents may, or may not, fill the trench. In some applications, particularly those in which the trench is dug by a clam shell digger, the spoils are left alongside the trench, and later may be moved to bury the pipeline. When this technique is used, the waterway is disturbed by suspended sediment twice and to the same degree. In addition, filling the trench this way requires two passes along the entire route of the underwater pipeline, doubling the cost of labor and the commitment of capital resources.

In short, all currently known equipment and methods for underwater trenching create large clouds of silt and debris that remain in suspension for a long time and seriously disrupt the ecology of the waterway. And backfilling the trench doubles the disruption.

A typical prior art underwater excavator or trencher is shown in Notarbartolo et al U.S. Pat. No. 2,659,211, which employs an excavator having a water jet which includes an auxiliary stream for unburying a cable. The spoils are merely blasted away wherever the water jet currents take them.

Another submarine pipeline trencher is disclosed in Roy U.S. Pat. No. 3,722,224, which teaches the use of a water jet and a vacuum unit that prevents spoils from resettling into the excavated trench, but the vacuumed material is simply discharged laterally and rearwardly of the apparatus, the object being merely to keep the spoils out of the newly formed trench. A pipe-burying jet sled is disclosed in Gaspar U.S. Pat. No. 4,295,757, which employs jetting legs for the water jets and, in addition, pressurized air for enhancing removal of sediment, which is discharged directly from the apparatus into the water, thereby forming large clouds of polluted water.

Another water jet-type apparatus is disclosed in Berti et al U.S. Pat. No. 4,479,741 which sucks the spoils out of the trench through scooping units by vacuum, allowing the matter to move freely in the water away from the trench.

While these references show that it is well known to use a tool such as a water jet for creating an underwater trench, the prior art does not show any means for containing or minimizing the spread of the spoils during trenching, or for disposal of the spoils, or for re-filling the trench. It has become apparent that large clouds of spoils suspended in the waterway are a hazard to all marine life, seriously disrupts the ecology of the waterway, despoil the appearance of the waterway, and should be avoided if possible.

Accordingly, there is a need for an underwater trenching system that contains much or all of the spoils during trenching to prevent their being dispersed in the waterway; that backfills the trench after the pipe has settled into the trench, using the same spoils removed to make the trench; and simplifies the trenching and backfilling process, thereby reducing the time and cost of laying underwater pipelines and cables.

SUMMARY OF THE INVENTION

Accordingly, it is a primary object of the present invention to provide an underwater trenching system that contains much or all of the spoils lifted from the bottom of the waterway during trenching to prevent them from being dispersed in the waterway.

It is another primary object of the invention to provide an underwater trenching system that backfills the trench after the pipe has settled into the trench, using the same spoils removed to form the trench.

It is a further object of the present invention to provide an underwater trenching system that simplifies the trenching and backfilling process, thereby reducing the time and cost of laying underwater pipelines and cables.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
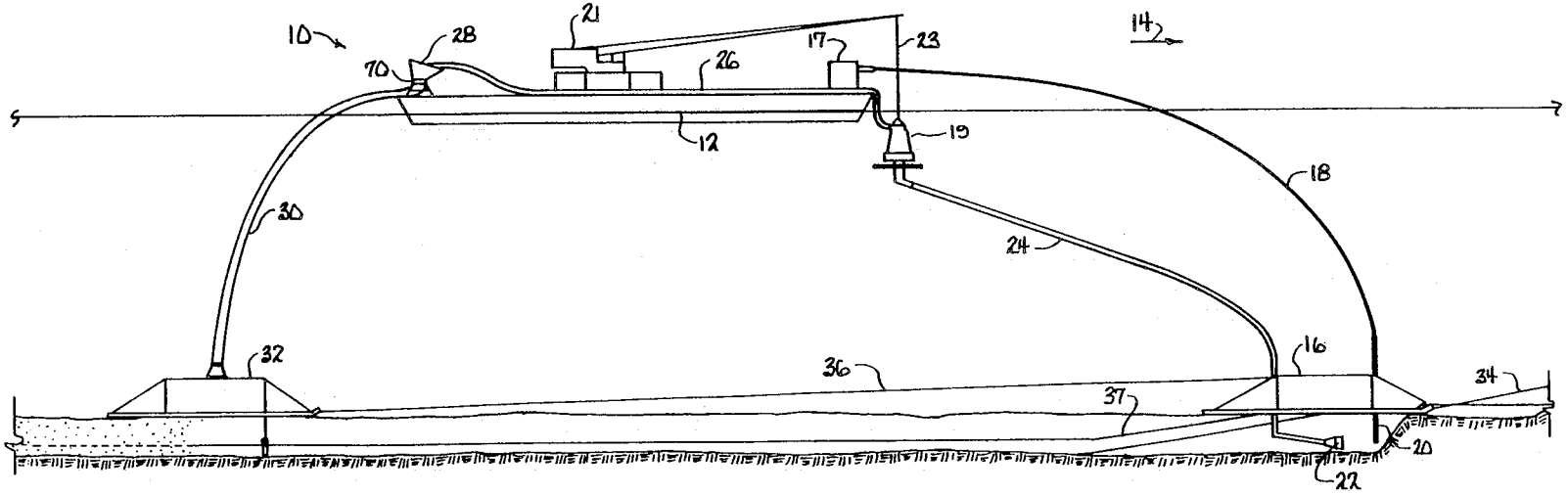
FIG. 1 is a side elevation of an underwater trenching system according to the present invention.

Referring to FIG. 1, there is shown a side elevation of the underwater trenching system 10. The system 10 is centered on barge 12 or other suitable vessel, which may operate while floating or submerged. As shown in FIG. 1, the system is moving from left to right in the direction of the arrow 14. An underwater trenching sled 16 includes high pressure water hoses 18 connected to a water pump 17 which provides high pressure water to the water jets 20 (see FIG. 3). The water jets 20 blast away sediment from the bottom of the waterway creating a trench. The uplifted sediment is contained within the walls of the trenching sled 16 and collected by the vacuum head 22, located under the sled 16 shell behind the water jets 20. Sediment sucked into the vacuum head 22 is drawn through the suction hose 24 and submersible pump 19, which creates the suction, into the pump discharge hose 26 and into the surge tank 28, located at the stern of the barge 10. The sediment is then discharged through the bury sled discharge hose 30, having a greater diameter than suction hose 24 so that the same volume of spoils and sediment can be discharged as was sucked in, but under less pressure so that the discharge of material through the bury sled 32 does not create significant turbulence that would simply disperse the sediment throughout the water body.

A tow cable 34 is connected to the front of the trenching sled 16 and a second tow cable 36 is fastened to the rear portion of trenching sled 16 and to the front of bury sled 32. The remote end of the tow cable 34 is fastened to a pulling means, such as another ship, or to a winch located on the shore, or a truck located on the shore. The underwater components, that is, the trenching sled 16, the bury sled 32 and associated hoses and cables, are pulled along by tow cable 34 at the desired speed. The barge 10 must naturally travel at the same speed. The actual speed of travel depends on the condition of the bottom of the waterway. For example, larger pumps and a slower rate of travel are called for in an area where the bottom material is clay than where the bottom material is sand or soft mud.

Figure 2:
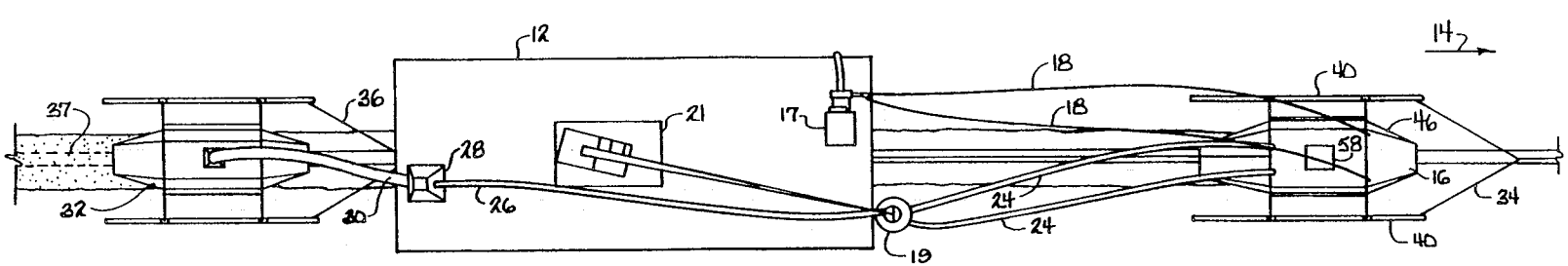
FIG. 2 is a plan view of an underwater trenching system according to the present invention.

The submersible pump 19 is suspended from the crane 21 by the cable 23 (the high pressure water is provided by the water pump 17, which draws its intake water directly from the water body). As shown in FIG. 2, the system employs two water jets 20, coupled to the water pump 17 by two independent high pressure water hoses 18, and two suction hoses 24 coupled to the submersible pump 19. This allows digging a wider trench than a sled having one water jet would allow. The preferred embodiment described herein is designed to dig trenches for pipes up to thirty-six inches in diameter.

Figure 3:
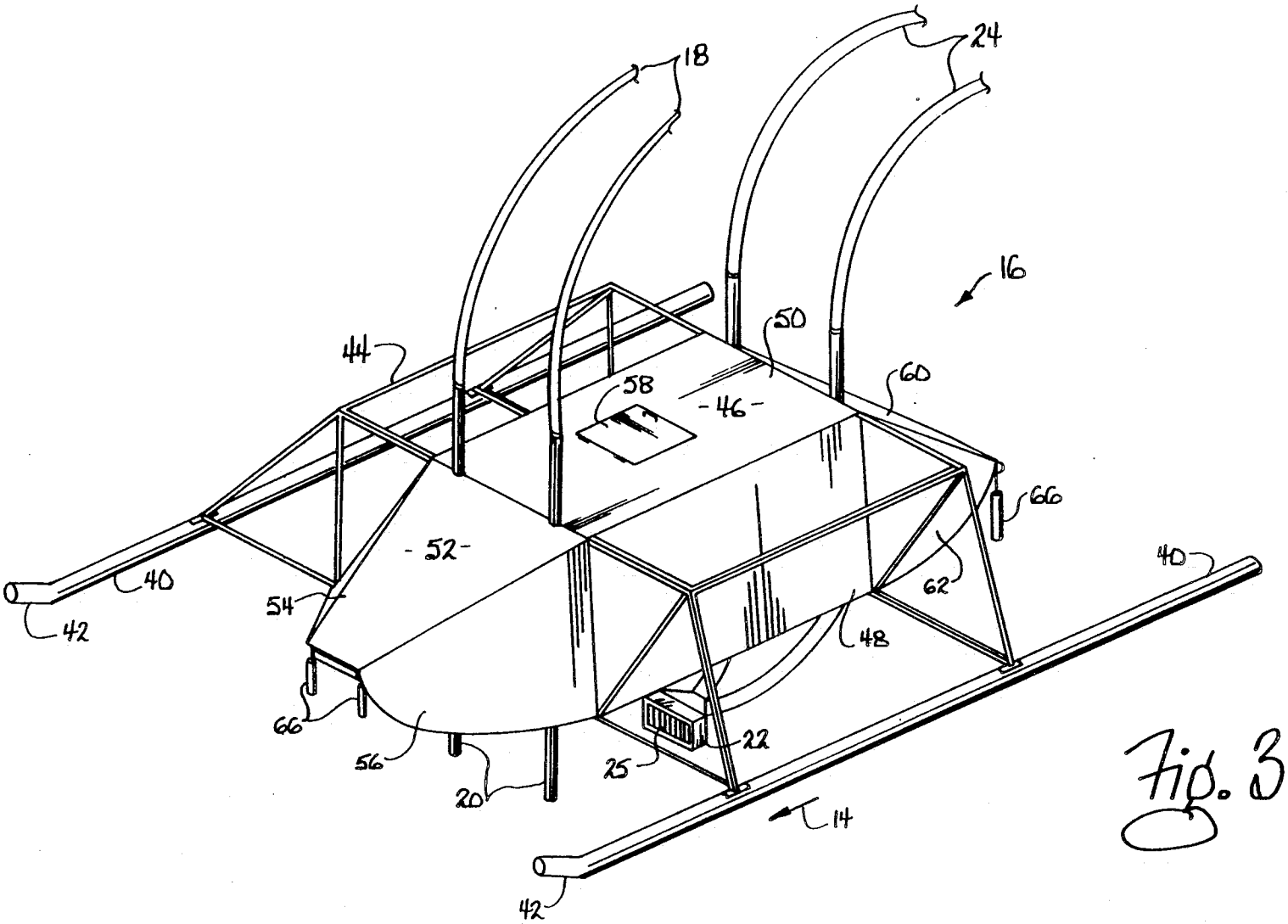
FIG. 3 is an isometric view of trenching sled.
Figure 4:
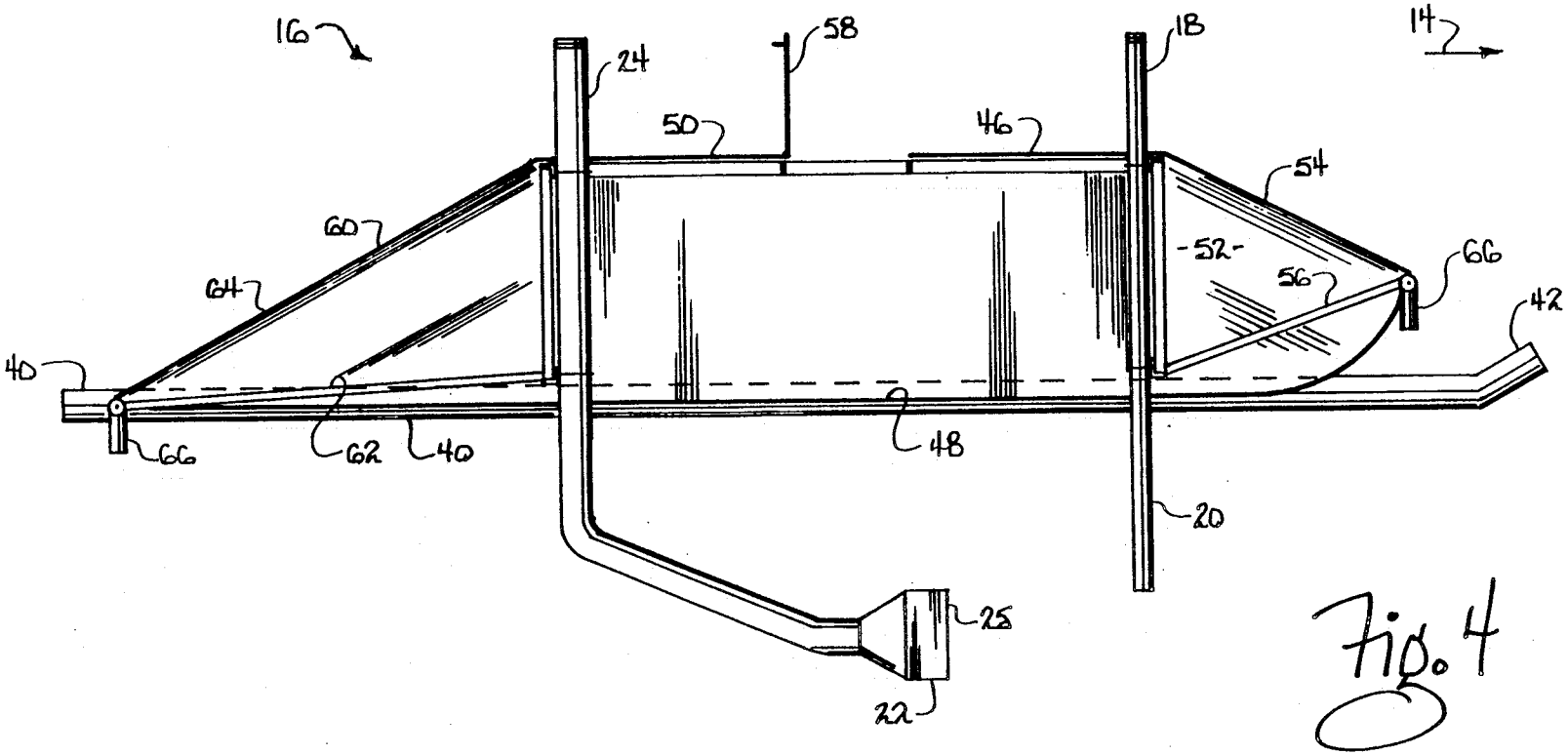
FIG. 4 is a side elevation of the trenching sled of FIG. 3.

Referring to FIG. 3, the trenching sled 16 rides on two parallel runners having upturned forward ends 42 prevent the runners 40 from plowing into the bottom. A frame 44 is attached at two points to each of the runners. A shell 46 is attached to the frame 44 to contain the sediment and spoils stirred up by the water jets 20.

The shell 46 consists of two vertical side walls 48, a top panel 50, a tapered nose portion 52 having a sloping top 54 and two side panels 56 that converge toward the longitudinal center line of the trenching sled 16, while flaring outwardly in a vertical plane to present a larger open area at the bottom of the side panels 56 than at sloping top 54. Alternatively, the shell 46 can be an integrally formed unitary shell that is directly connected to the runners.

A hatch 58 in the top panel 50 allows a diver access to the interior of the trenching sled 16 if required, such as for removing debris from the intake grate 25 of the vacuum head 22. The rear portion of the shell 46 is a mirror image of the tapered nose portion 52, comprising a sloping rear panel 60 and two inward sloping converging rear portion side panels 62. The tapered tail portion 64 of the shell 46 is constructed and shaped exactly the same as tapered nose portion 52, however, it is longer in order to allow for collection of a greater portion of the removed sediment.

A pair of vertically-oriented spaced roller guides 66 hangs from the leading edge of the tapered nose portion 52 and another pair of roller guides 66 hangs from the trailing edge of tapered tail portion 64. The roller guides 66 are intended to straddle the pipe or cable and keep the trenching sled 16 aligned with the pipe.

Figure 5:
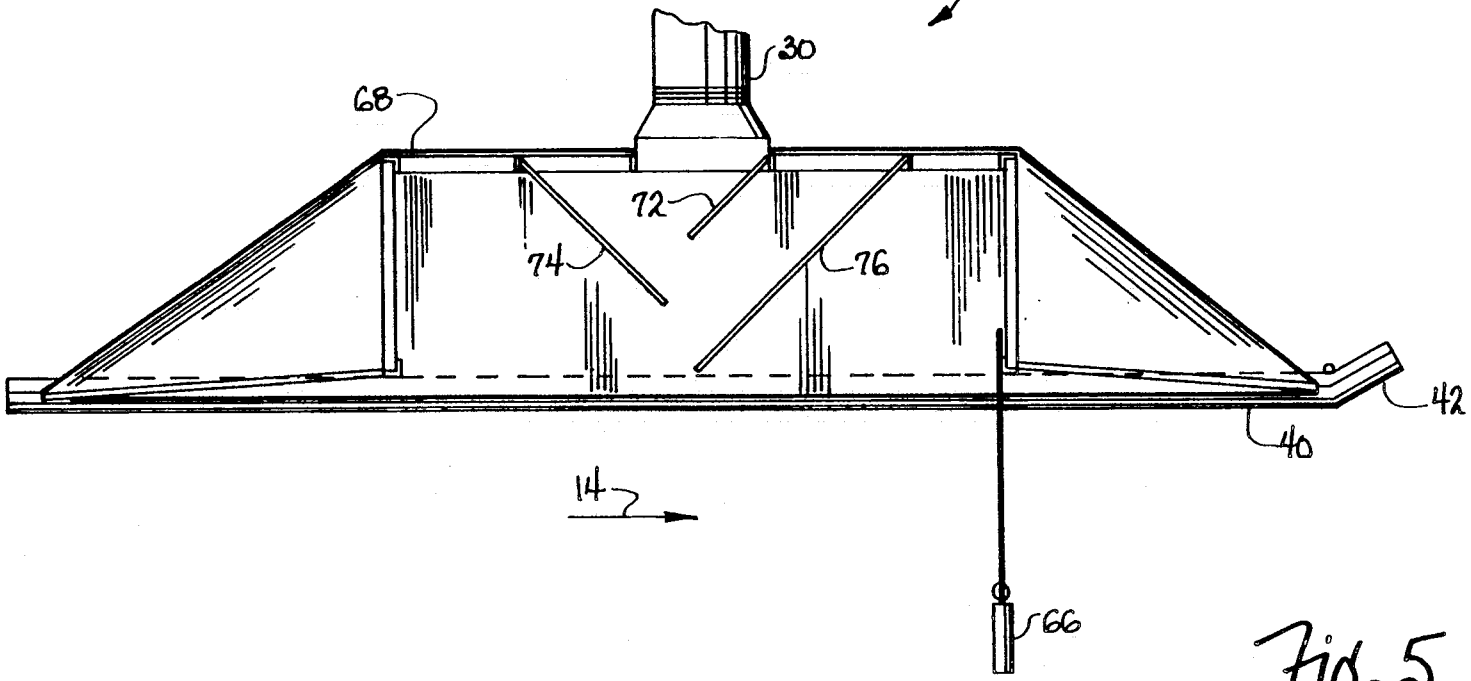
FIG. 5 is a side elevation of the bury sled.

Referring to FIG. 5, the bury sled 32 is of the same general construction and shape as the trenching sled 16. Therefore, only the differences between the two sleds will be discussed herein. The bury sled 32 is smaller than the trenching sled 16, notably shorter, because less pressure is used in re-depositing the sediment vacuumed up by the submersible pump 19. In fact, only the force of gravity is used to feed the sediment from surge tank 28 through the bury sled discharge hose 30 and into the shell 68 of the bury sled 32. Surge tank 28 may conveniently have a top opening of eight feet by eight feet (8'×8') (2.5m×2.5m) and be approximately six feet (6') (1.8m) deep, with an appropriate valve 70 for controlling the allowable rate of flow through the bury sled discharge hose 30. Inside the shell 68 is a series of baffles 72, 74, 76 that diffuse the flow of sediment and water and reduce the turbulence created in re-depositing the excavated sediment. The bury sled discharge hose 30 has a significantly greater diameter than suction hoses 24 so that the same rate of material flow can be maintained at the much lower pressure.

In this preferred embodiment, high pressure water pump, submersible pump 19, high pressure water hoses 18, suction hoses 24, bury sled discharge hose, and like components are readily available and well known. Trenching sled 16 and bury sled 32 are preferably made from metal, with the runners 40 comprising six inch (6") (15cm) diameter steel pipe having caps on the ends thereof, frame 44 is made from pipes or beams, and shell 46 is fabricated from metal. Naturally, these components must be durable and stand up under rugged use.

The underwater trenching system 10 described herein is a closed trenching system in the sense that much or all of the sediment removed during trenching is contained within the system and then re-deposited in the trench. A significant distance of 200 to 300 (60m–90m) feet must separate the trenching sled 16 from the bury sled 32 so that the pipe has enough time to settle into the trench prior to backfilling.

It is to be understood that while certain forms of this invention have been illustrated and described, it is not limited thereto, except in so far as such limitations are included in the following claims.

Having thus described the invention, what is claimed as new and desired to be secured by Letter Patents is:

1. An underwater trenching system comprising:

an underwater trenching sled including means for trenching along the bottom of a waterway;

vacuum means for sucking up sediment, said vacuum means having an intake end at said trenching sled and a discharge end;

an underwater bury sled; and means for coupling said bury sled to said vacuum means, including discharge hose means extending from said discharge end of the vacuum means to said bury sled.

2. An underwater trenching system in accordance with claim 1 further comprising means for moving said trenching sled and said bury sled through the water.

3. An underwater trenching system in accordance with claim 2 wherein said sled moving means comprises a first tow cable connected to said trenching sled and a second tow cable connected at one end to said trenching sled, with said bury sled being behind said trenching sled in relation to the direction of travel of said system, and said second tow cable being attached at its other end to said bury sled.

4. An underwater trenching system in accordance with claim 1 wherein said trenching sled comprises:

(a) a pair of parallel, generally horizontally disposed runners;

(b) a shell attached to said runners;

(c) said means for trenching penetrating said trenching sled shell and being attached to a power means both for excavating an underwater trench; and (d) said vacuum means intake end for sucking up sediment dug up by said trenching means.

5. An underwater trenching system in accordance with claim 4 wherein said trenching means comprises at least one water jet, said power means includes a high pressure water pump, and said system further comprises means for coupling said trenching means with said power means.

6. An underwater trenching system in accordance with claim 4 wherein said vacuum means further comprises a vacuum head presenting said intake end within said trenching sled shell, at least one vacuum hose connected to said vacuum head, and a pump connected to the other end of said at least one hose.

7. An underwater trenching system in accordance with claim 6 wherein said pump is a submersible pump.

8. An underwater trenching system in accordance with claim 4 wherein said trenching sled further comprises a pair of roller guides attached proximate to the leading edge of said trenching sled and a pair or roller guides attached proximate to the trailing edge of said trenching sled.

9. An underwater trenching system in accordance with claim 4 wherein said trenching sled further comprises a tapered nose portion and a tapered tail portion.

10. An underwater trenching system in accordance with claim 1 wherein said bury sled comprises:

(a) a pair of parallel, generally horizontally disposed runners; and (b) a shell attached to said runners and connected to said discharge hose means for receiving sediment therefrom and depositing the sediment in the trench.

11. An underwater trenching system in accordance with claim 10 wherein said bury sled further comprises means for diffusing the sediment flowing into said shell.

12. An underwater trenching system in accordance with claim 11 wherein said diffusing means comprises at least one baffle.

13. An underwater trenching system in accordance with claim 10 wherein said bury sled further comprises at least one pair of guide rollers attached proximate to a leading portion of said bury sled.

14. An underwater trenching system in accordance with claim 1 further comprising a floating vessel, and wherein said coupling means further includes a surge bin located on said floating vessel whereby the vacuumed sediment flows through said discharge hose means to said bury sled under the force of gravity only.

15. An underwater trenching system in accordance with claim 14 wherein said surge bin includes a discharge opening in its bottom and a valve controlling said discharge opening.

16. An underwater trenching system comprising:

(a) a floating vessel;

(b) an underwater trenching sled comprising a shell attached to a frame, which is attached to a pair of parallel, generally horizontally disposed runners, means for trenching the bottom of a waterway, and means for sucking up the sediment disturbed by said trenching means;

(c) an underwater bury sled comprising a shell attached to a frame, which is attached to a pair of parallel, generally horizontally disposed runners, and means for discharging the sediment sucked up by said trenching sled;

(d) means for conveying the sediment from said trenching sled to said bury sled; and (e) a surge bin disposed on said vessel interposed in said conveying means.

* * * * *